US008403134B1

(12) United States Patent
Kantgias et al.

(10) Patent No.: US 8,403,134 B1
(45) Date of Patent: Mar. 26, 2013

(54) PORTABLE STORAGE DEVICE FOR ATHLETIC EQUIPMENT

(75) Inventors: J. Christopher Kantgias, Bloomfield Hills, MI (US); Dennis Miller Alderson, Port Huron, MI (US); Dennis Steven Handy, St. Clair, MI (US)

(73) Assignee: SDK 2011, LLC, Roseville, MI (US)

( * ) Notice: Subject to any disclaimer, the term of this patent is extended or adjusted under 35 U.S.C. 154(b) by 210 days.

(21) Appl. No.: 13/081,175

(22) Filed: Apr. 6, 2011

(51) Int. Cl.
*B65D 85/20* (2006.01)

(52) U.S. Cl. ..... 206/315.1; 206/579; 206/736

(58) Field of Classification Search ..... 206/315.1, 206/575, 577, 579, 736, 6.1; 190/14, 21, 190/18 R, 103
See application file for complete search history.

(56) References Cited

U.S. PATENT DOCUMENTS 1,717,841 A * 6/1929 Galloway ..... 190/14
4,066,156 A * 1/1978 Basile ..... 190/18 A
4,809,892 A * 3/1989 Chinski et al. ..... 224/155
4,880,089 A * 11/1989 Chombert et al. ..... 190/18 R
6,196,366 B1 * 3/2001 Lin ..... 190/18 A
7,644,810 B2 * 1/2010 Duncan ..... 190/8
2005/0121275 A1 * 6/2005 Platte ..... 190/103
2007/0034546 A1 * 2/2007 Vosloo ..... 206/579

* cited by examiner

*Primary Examiner* — David Fidei
(74) *Attorney, Agent, or Firm* — Dykema Gossett PLLC

(57) ABSTRACT

A portable storage device for athletic equipment is provided. The device includes a frame defining a floor and a plurality of walls extending from the floor, each of the plurality of walls having interior and exterior sides. The interior sides of the walls define a space therebetween. The device further includes an arm supported by the frame, the arm adjustable between a collapsed state and an extended state. The device further includes a flexible sheet adjustable between a first state in which the flexible sheet is collapsed and configured to be disposed within the space and a second state in which the flexible sheet is extended and configured to be supported by the arm when the arm is in the extended state. The flexible sheet includes a restraining member configured to receive a portion of an elongate item of athletic equipment extending between the floor and the restraining member.

20 Claims, 6 Drawing Sheets

PORTABLE STORAGE DEVICE FOR ATHLETIC EQUIPMENT

BACKGROUND OF THE INVENTION

1. Field of the Invention

This invention relates to a storage device for athletic equipment and, in particular, to a portable storage device for transporting and retaining elongate items of athletic equipment such as hockey sticks and related athletic equipment.

2. Discussion of Related Art

Numerous team athletic activities require individual players on the team to have their own athletic equipment. For example, each player on a hockey or lacrosse team will typically have one or more hockey or lacrosse sticks. Each player on a baseball or softball team may have their own bat. The volume of athletic equipment required in these type of team activities creates difficulties in organizing the equipment and in transporting the equipment.

In ice hockey, for example, hockey sticks and other equipment are often propped up against walls or left on the floor as players prepare and wait their time on the ice. When that time arrives, there is little time available to transport all of the team's equipment to the team bench or other designated area and organize that equipment-particularly as players previously using the ice gather their own equipment. In addition to the loss of valuable time involved in transporting and organizing the equipment, the equipment is susceptible to damage or loss as players move to and away from the playing surface and intermingle with players and personnel from other teams.

The inventors herein have recognized a need for a portable storage device for athletic equipment that will minimize and/or eliminate one or more of the above-identified deficiencies.

SUMMARY OF THE INVENTION

The present invention provides a storage device for athletic equipment. In particular, the invention provides a portable storage device configured to support elongate items of athletic equipment (e.g., hockey sticks).

A portable storage device for athletic equipment in accordance with one embodiment of the invention includes a frame defining a floor and a plurality of walls extending from the floor. Each of the plurality of walls has an interior side and an exterior side. The interior sides of the plurality of walls define a space therebetween. The device further includes one or more arms supported by the frame. The arms are adjustable between a collapsed state and an extended state. The device further includes a flexible sheet adjustable between a first state in which the flexible sheet is collapsed and configured to be disposed within the space and a second state in which the flexible sheet is extended and configured to be supported by the arms when the arms are in the extended state. The flexible sheet includes a restraining member configured to receive a portion of an elongate item of athletic equipment extending between the floor and the restraining member.

A portable storage device for athletic equipment in accordance with the present invention is advantageous because it allows the efficient transportation and storage of athletic equipment and, particular, elongate items of athletic equipment such as hockey sticks, lacrosse sticks, and baseball and softball bats. As a result, players, coaches and other personnel will lose less time in transporting and organizing equipment and valuable equipment is less likely to be damaged or lost.

These and other advantages of this invention will become apparent to one skilled in the art from the following detailed description and the accompanying drawings illustrating features of this invention by way of example.

DETAILED DESCRIPTION OF EMBODIMENTS OF THE INVENTION

Figure 1:
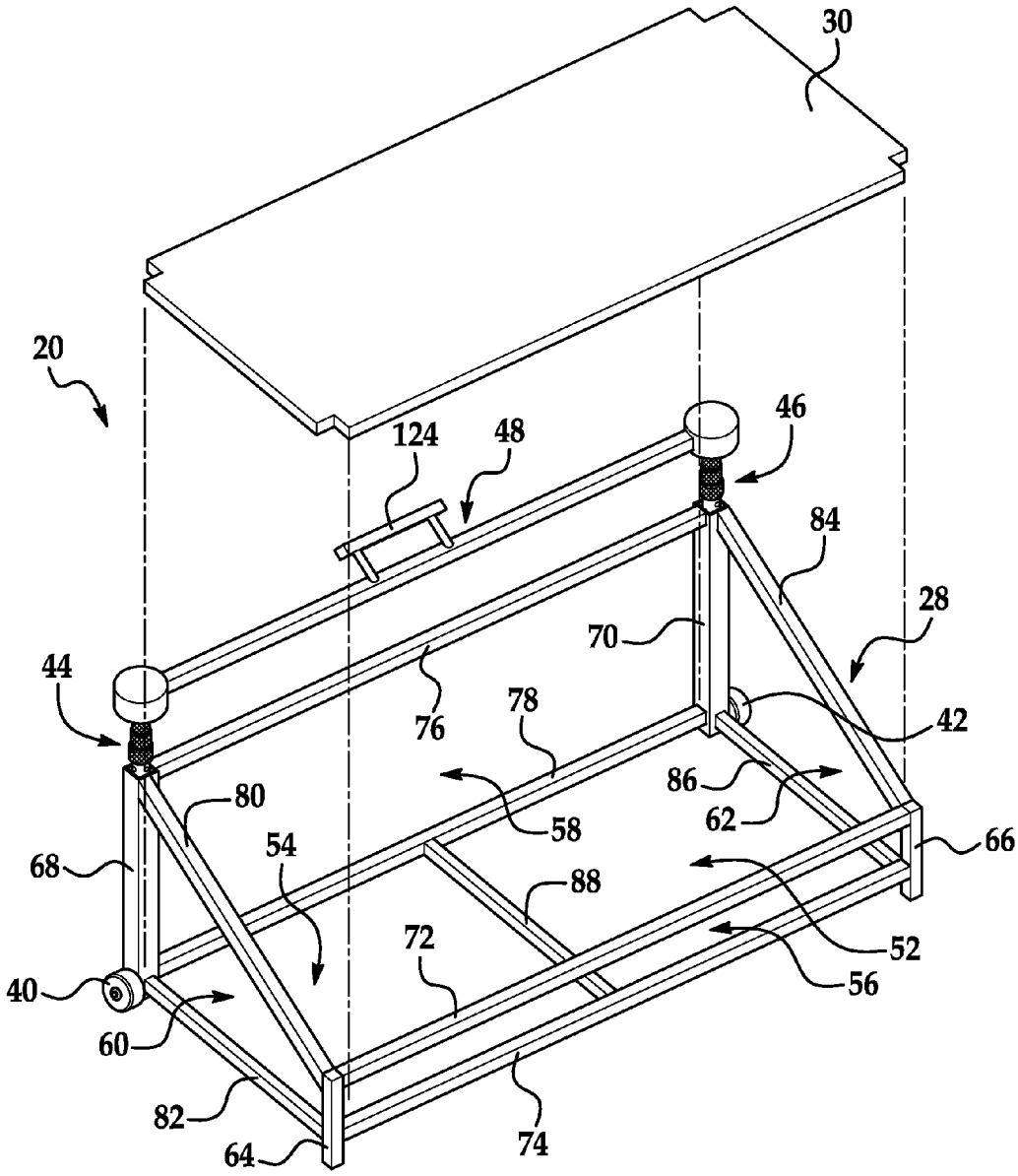
FIG. 1 is an exploded perspective view of a frame and flooring portion of a portable storage device for athletic equipment in accordance with one embodiment of the present invention.
Figure 2:
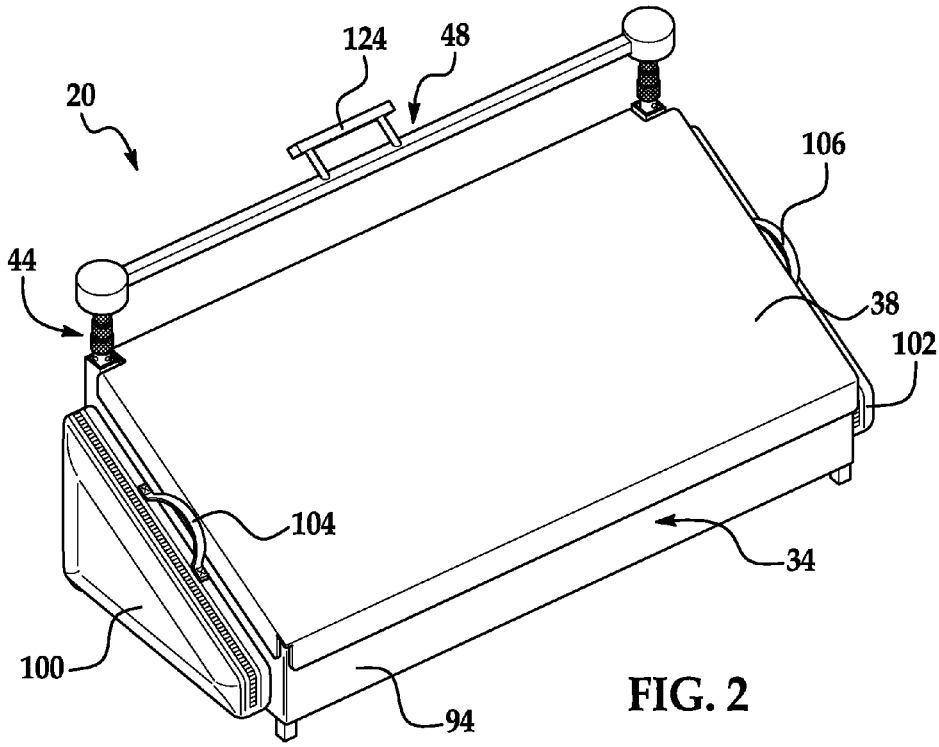
FIGS. 2-3 are perspectives view of a portable storage device for athletic equipment in accordance with one embodiment of the present invention.
Figure 3:
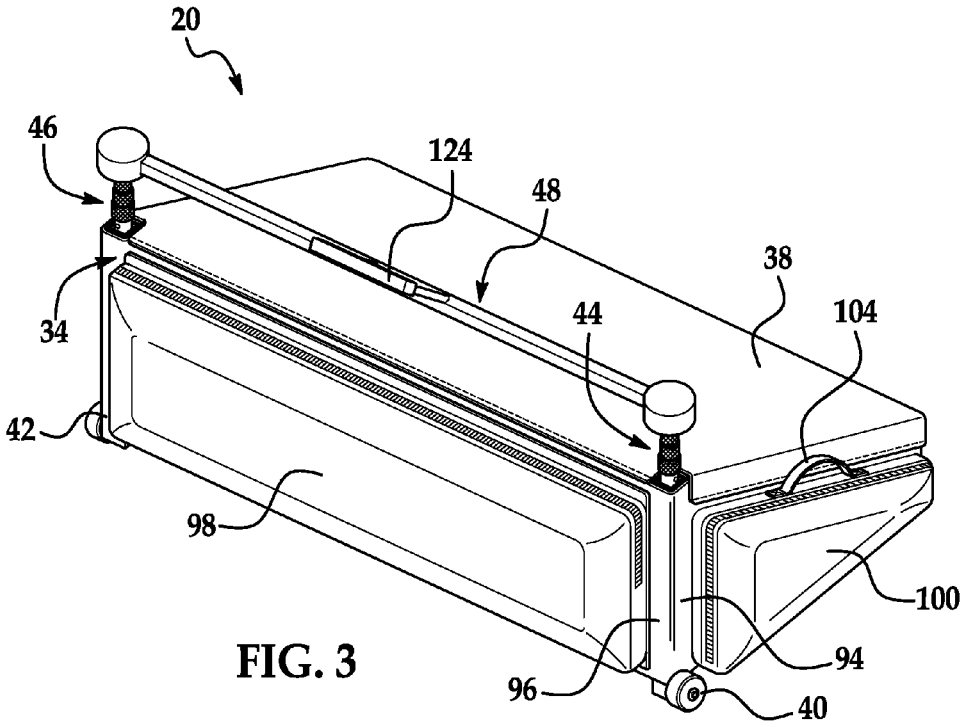
Figure 4:
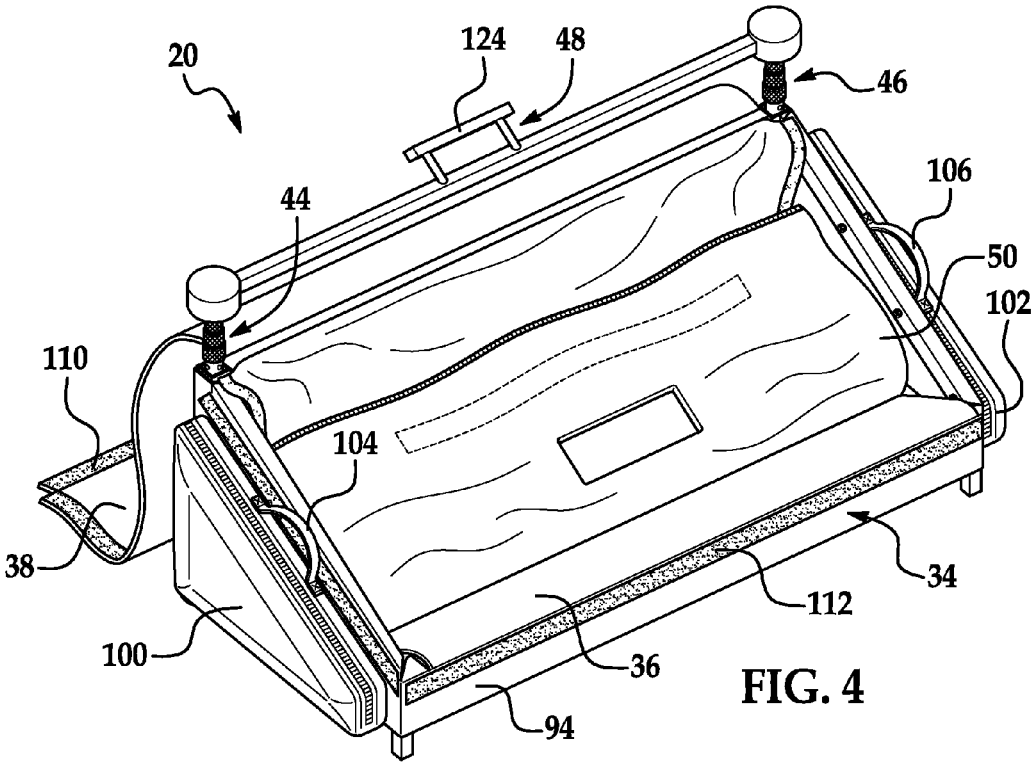
FIG. 4 is a perspective view of the portable storage device of FIGS. 2-3 partially opened and illustrating a pair of extension arms and a flexible sheet in collapsed states with the flexible sheet stored in the device.
Figure 5:
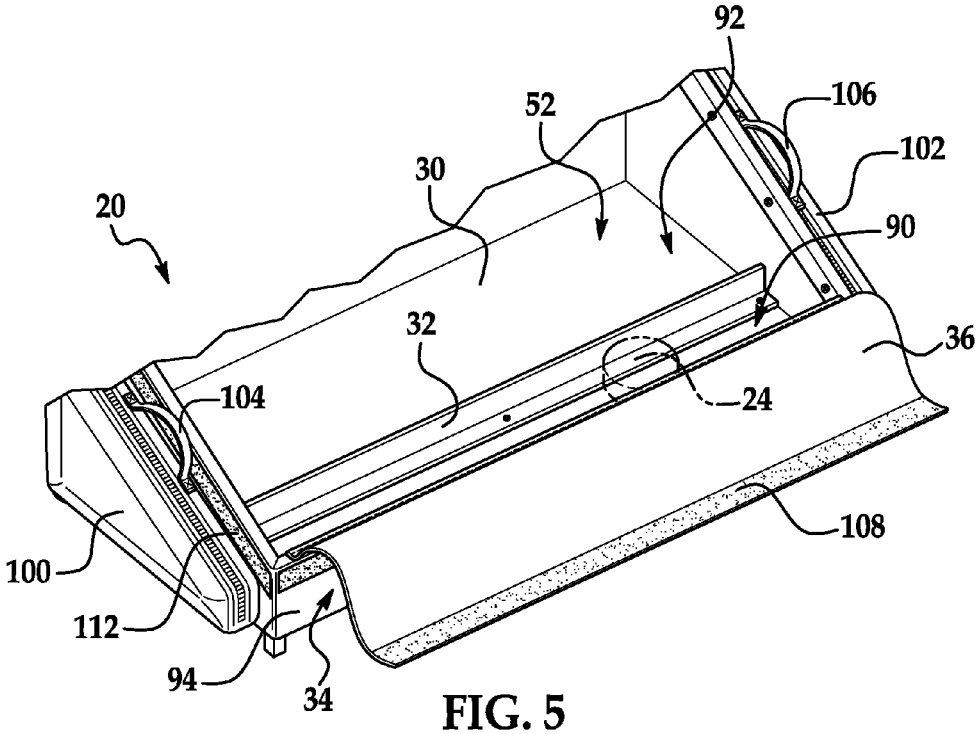
FIG. 5 is a perspective view of a portion of the portable storage device of FIGS. 2-3 partially opened.

Referring now to the drawings wherein like reference numerals are used to identify identical components in the various views, FIGS. 1-7 illustrate a portable storage device 20 for athletic equipment in accordance with one embodiment of the present invention. Device 20 is particularly adapted for transportation and storage of elongate items of athletic equipment such as hockey sticks (including ice hockey, field hockey, roller hockey and floor hockey sticks), lacrosse sticks and baseball and softball bats. In the illustrated embodiment, device 20 is configured for transportation and storage of athletic equipment used for ice hockey including hockey sticks 22, pucks 24, and water bottles 26 and other equipment such as a first aid kit, coaching boards and the like (not shown). It should be understood, however, that device 20 could be appropriately configured for transportation and storage of athletic equipment relating to other sports including, for example, field hockey, floor hockey, lacrosse, baseball and softball. Device 20 may include a frame 28, flooring 30, divider 32, covering 34, covers 36, 38, wheels 40, 42, arms 44, 46, handle 48, and a flexible sheet 50.

Referring to FIG. 1, frame 28 provides structural support for the other components of device 20 and defines a space 52 for storage of athletic equipment and components of device 20 such as sheet 50. Frame 28 defines a floor 54 and a plurality of walls 56, 58, 60, 62 extending from floor 54. Each of walls 56, 58, 60, 62 has an interior side and an exterior side with the interior sides defining space 52 therebetween. Frame 28 may be made from a variety of conventional metals and metal alloys or plastics. Frame 28 may include a plurality of frame members including corner members 64, 66, 68, 70, front cross members 72, 74, rear cross members 76, 78, and side cross members 80, 82 and 84, 86 and bottom cross member 88. Frame members 64, 66, 68, 70, 72, 74, 76, 78, 80, 82, 84, 86, 88 may be connected to one another using conventional fasteners such as welds. It should also be understood, however, that frame 28 could be constructed as a unitary, or one-piece, structure thereby eliminating the need for any fasteners. All or some of frame members 64, 66, 68, 70, 72, 74, 76, 78, 80, 82, 84, 86, 88 may be tubular in construction to thereby reduce the weight of device 20 and provide a means for housing components of device 20 such as arms 44, 46, as described in greater detail hereinbelow. It should be understood, however, that frame members 64, 66, 68, 70, 72, 74, 76, 78, 80, 82, 84, 86, 88 could alternatively be solid members. Frame members 64, 66, 68, 70, 72, 74, 76, 78, 80, 82, 84, 86, 88 are rectilinear in cross-section and, in particular, may be substantially square in cross-section. It should be understood, however, that the cross-sectional shape of frame members 64, 66, 68, 70, 72, 74, 76, 78, 80, 82, 84, 86, 88 may vary.

Corner members 64, 66, 68, 70, define the height, length and width of space 52. Corner members 68, 70 are longer than corner members 64, 76 in the illustrated embodiment such that frame 28 defines a space 52 that is increases in height progressing from the front of frame 28 to the rear of frame 28. It should be understood, however, that the size, shape of corner member 64, 66, 68, 70 and space 52 may vary depending on the application. Corner members 68, 70 are configured to house a portion of arms 44, 46 as described in greater detail hereinbelow. Corner members 68, 70 are also configured to mount wheels 40, 42 and may include axle tubes (not shown) extending therethrough and configured to receive axles on which wheels 40, 42 are mounted. Corner members 64, 66 project downward further than corner members 68, 70 and—together with wheels 40, 42—support device 20 on ground surfaces (e.g., grass, ice, floors, etc.)

Front cross members 72, 74, rear cross members 76, 78, right side cross members 80, 82, and left side cross members 84, 86 combine with corner members 64, 66, 68, 70 to define floor 54 and front, rear and side walls 56, 58, 60, 62 extending from floor 50. The bottommost member of each pair of cross members (i.e., members 74, 78, 82, 86) may be connected to corner members 64, 66, 68, 70 at a distance from the longitudinal end of corner members 64, 66, 68, 70 such that the floor 54 defined by frame 28 is disposed above a ground surface and corner members 64, 66, 68, 70, support floor 54 above that surface. As a result, flooring 30 suffers less direct exposure to water, grass and other elements and the useful life of flooring 30 is extended. The uppermost member of the front and rear cross members (i.e., members 72, 76) are disposed at different heights in the illustrated embodiment, such that the height of rear wall 58 is greater than the height of front wall 56 and space 52 increases in height progressing from the front of frame 28 to the rear of frame 28.

Floor cross member 88 provides additional structural support to for flooring 30. Member 88 extends between, and is connected to, front cross member 74 and rear cross member 78. It should be understood that cross member 88 could alternatively extend between and be connected to side cross members 82, 86 and that more than one floor cross member could be used.

Flooring 30 provides a surface to support athletic equipment transported and/or stored using device 20. Flooring 30 may be made from woods or other conventional materials. An interior side of flooring 30 may be covered with various materials intended to prevent degradation of flooring 30 and/or athletic equipment depending on the application for device 20. Flooring 30 may be configured to rest on an upper surface of the bottommost cross members 74, 78, 82, 86 and floor cross member 88. In addition, or in the alternative, flooring 30 may be configured to be fastened to one or more of members 74, 78, 82, 86, 88 using conventional fasteners such as screws, bolts, rivets, welds and adhesives.

Divider 32 is provided to divide space 52 into multiple subspaces 90, 92. Divider 32 may be made from conventional metals and metal alloys or plastics. In the illustrated embodiment, divider 32 extends longitudinally across flooring 30 and floor 54 and creates a subspace 90 configured to house hockey pucks 24. It should be understood, however, that the number and location of dividers may vary depending on the application. Divider 32 may be L-shaped in cross-section, defining a flange fastened to flooring 30 using conventional fasteners such as screws, bolts, rivets, welds and adhesives. Alternatively, or in addition, divider 32 may be fastened to frame 28 using similar fasteners.

Covering 34 is provided to partially enclose space and may form a portion of walls 56, 58, 60, 62. Covering 34 may be made from conventional materials including canvas and/or woven polyester thread such as the material sold under the trademark "BAINTEX 600" by Bainbridge International, Inc. In one constructed embodiment, covering 34 is made from multiple sheets of canvas and/or woven polyester thread that may be sewn together including one sheet 94 configured to cover front wall 56 and side walls 58, 60, and a second sheet 96 configured to cover rear wall 62. Covering 34 may be fastened to frame 28 using conventional fasteners such as screws, bolts, rivets, and adhesives. In one constructed embodiment, one end of each sheet 94, 96 of covering 34 is fastened to an interior side of one or more of the uppermost members of the front, rear, right side and left side cross members (i.e., members 72, 76, 80, 84) while another end of each sheet 94, 96 of covering 34 is fastened to an interior side of one or more of the bottommost members of the front, rear, right side and left side cross members (i.e., members 74, 78, 82, 86) thereby maintaining a generally smooth exterior surface. Covering 34 may include additional sheets of material sewn to or otherwise fastened to sheets 94, 96 to form storage compartments 98, 100, 102 on the interior and/or exterior sides of walls 56, 58, 60, 62. In the illustrated embodiment, storage compartments 98, 100, 102 are formed on rear wall 58 and side walls 60, 62 by attaching one or sheets of material to sheets 94, 96. Storage compartments 98, 100, 102, may be open. Alternatively, compartments 98, 100, 102 may have means for closing compartments 98, 100, 102, such as a zipper, buttons, snaps, or other conventional devices. Covering 34 may also include strips of material sewn or otherwise attached to sheets 94, 96 or to the sheets forming compartments 100, 102 at either longitudinal end so as to form handles 104, 106. In the illustrated embodiment, one such handle 104, 106, is formed on each of side walls 60, 62.

Cover 36 is provided to enclose subspace 90 formed by divider 32. Cover 36 may be may be made from the same materials as covering 34. Cover 36 extends longitudinally between side walls 60, 62 in the illustrated embodiment. One transverse end of cover 36 may be sewn or otherwise fastened to sheet 94 of covering 34 at a location on an upper side of the uppermost front cross member 72 to couple cover 36 to frame 28. The other transverse end of cover 36 may include means for fastening cover 36 to divider 32 to enclose subspace 90. In one constructed embodiment, a hook and loop fastener (e.g., the fastener sold under the trademark "VELCRO") is used with cover 36 including one or more strips 108 of hooks or loops and divider 32 including one or more strips of the other on a side of divider 32 facing rear wall 58.

Cover 38 is provided to enclose space 52 for secure transportation and storage of athletic equipment and sheet 50 as described hereinbelow. Cover 38 may be may be made from the same materials as covering 34. Cover 38 extends longitudinally between side walls 60, 62 and a portion of cover 38 extends beyond side walls 60, 62 in the illustrated embodiment. One transverse end of cover 38 may be sewn or otherwise fastened to sheet 96 of covering 34 at a location on an upper side of the uppermost rear cross member 76 to couple cover 38 to frame 28. The other transverse end of cover 38 may extend beyond front wall 56. The portions of cover 38 extending beyond side walls 60, 62 and front wall 56 may include means for fastening cover 38 to covering 34 to enclose space 52 and further couple cover 38 to frame 28. In one constructed embodiment, a hook and loop fastener (e.g., the fastener sold under the trademark "VELCRO") is used with cover 38 including one or more strips 110 of hooks or loops at each longitudinal end and at one transverse end and covering 34 including one or more strips 112 of the other on the exterior surfaces of covering 34 forming front wall 56 and side walls 60, 62.

Wheels 40, 42 are provided to assist in transporting device 20. Wheels 40, 42 may be made from rubber. As used herein, "wheels" refers to a structure capable of to turning on an axis and may include, for example, rollers, casters and the like. In the illustrated embodiment, wheels 40, 42 are mounted to the outboard sides of corner members 68, 70 of frame 28 on axles extending into corner members 68, 70. It should be understood that device 20 may include additional wheels and that additional wheels could be affixed at various locations on device 20 (e.g., to corner members 64, 66 or to any of cross members 74, 78, 82, 86, 88).

Arms 44, 46 provide a means for bearing sheet when sheet 50 is an extended state as discussed hereinbelow. Arms 44, 46 are supported by frame 28 and are adjustable between a collapsed state shown in FIGS. 1-4 and an extended state shown in FIGS. 6-7. Arms 44, 46 may each comprise a plurality of telescoping members 114. When in the collapsed state, members 114 of arms 44, 46, are at least partially disposed within corner members 68, 70 of frame 28. Members 114 may be made from conventional metals and metal alloys and plastics and are made from aluminum in one constructed embodiment. In the illustrated embodiment members 114 are circular in cross-section, but it should be understood that the shape of members 114 may vary. Arms 44, 46 include means for locking the telescoping members 114 in position relative to other members 114. Referring to FIG. 8A and FIG. 8B, the locking means may include knobs 116 extending radially outwardly from members 114 that are biased (e.g. by a spring (not shown)) through corresponding apertures 118 in an adjacent member 114. In addition, or in the alternative, the locking means may include sleeves 120 disposed about members 114 and having a plurality of internal threads (not shown) configured to engage a corresponding set of threads 122 on the outer surface of one end of an adjacent member 114.

Referring again to FIGS. 1-4, handle 48 is provided to assist in transporting device 20 between locations. Handle 48 may also provide additional means for supporting sheet 50 as described in greater detail below. Handle 48 may be made from conventional metals, metal alloys or plastics. Handle 48 connects arms 44, 46 and may be oriented substantially perpendicular to arms 44, 46. In particular, handle 48 may be connected to one longitudinal end of the smallest telescoping member 114 of each arm 44, 46. In the illustrated embodiment, a hand grip 124 projects from handle 48 at an angle to allow a person to grip handle 48 comfortably when device 20 is tipped rearwards onto wheels 40, 42 for transportation of device 20.

Flexible sheet 50 provides a means for supporting various athletic equipment including, in particular, elongate items of athletic equipment such as hockey sticks 22. Sheet 50 may be made from conventional materials including canvas and/or woven polyester thread such as the material sold under the trademark "BAINTEX 600" by Bainbridge International, Inc. Sheet 50 is adjustable between a first state shown in FIG. 4 in which sheet 50 is collapsed for storage within space 52 (e.g. during transportation or nonuse of device 20) and a second state shown in FIGS. 6-7 in which sheet 50 is extended to support athletic equipment such as hockey sticks 22. Sheet 50 may comprise a single sheet of material or multiple sheets of material sewn or otherwise fastened together.

Figure 6:
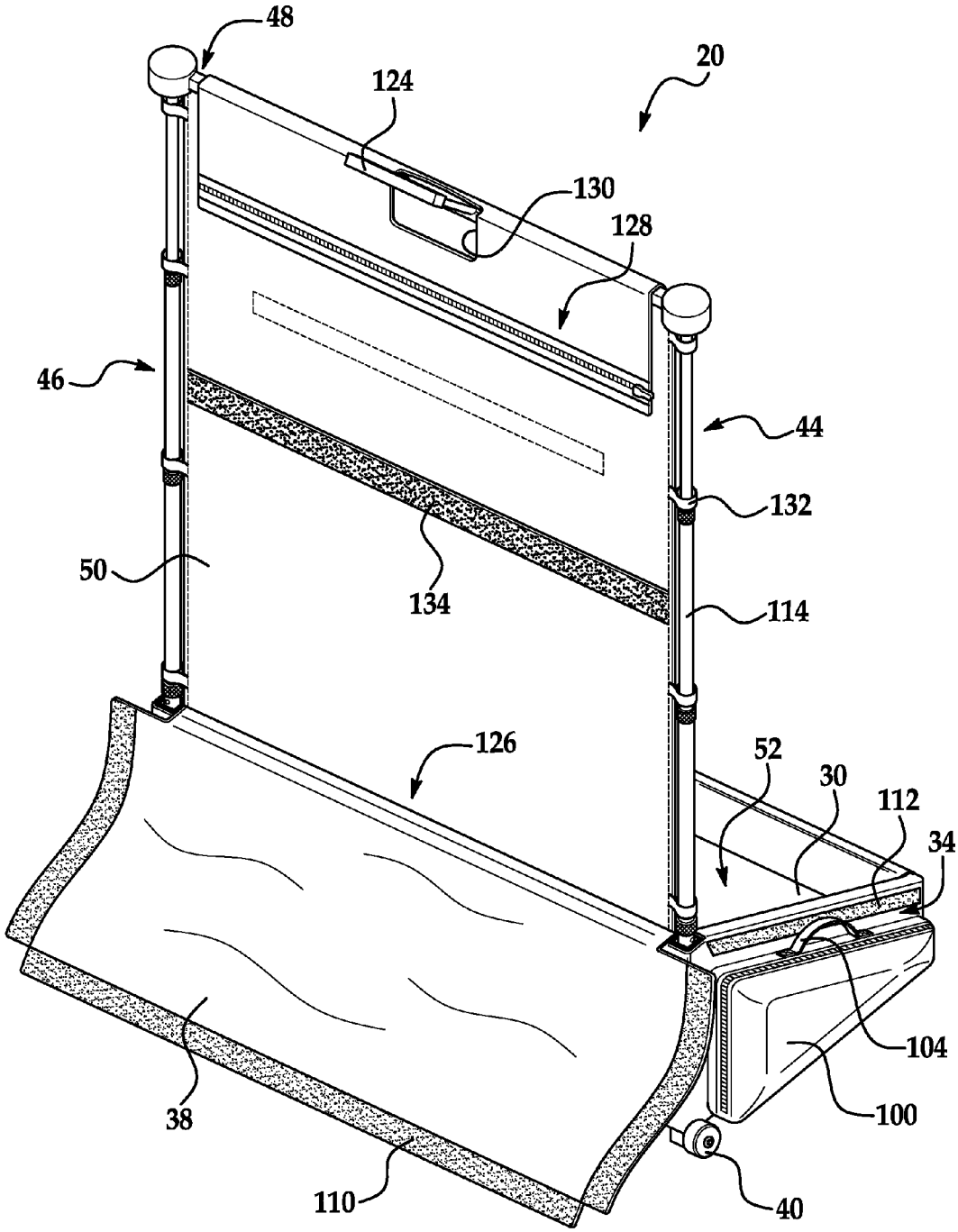
FIGS. 6-7 are perspective views of the portable storage device of FIGS. 2-3 fully opened and illustrating the extension arms and flexible sheet in extended states with the flexible sheet supported on the extended arms.
Figure 7:
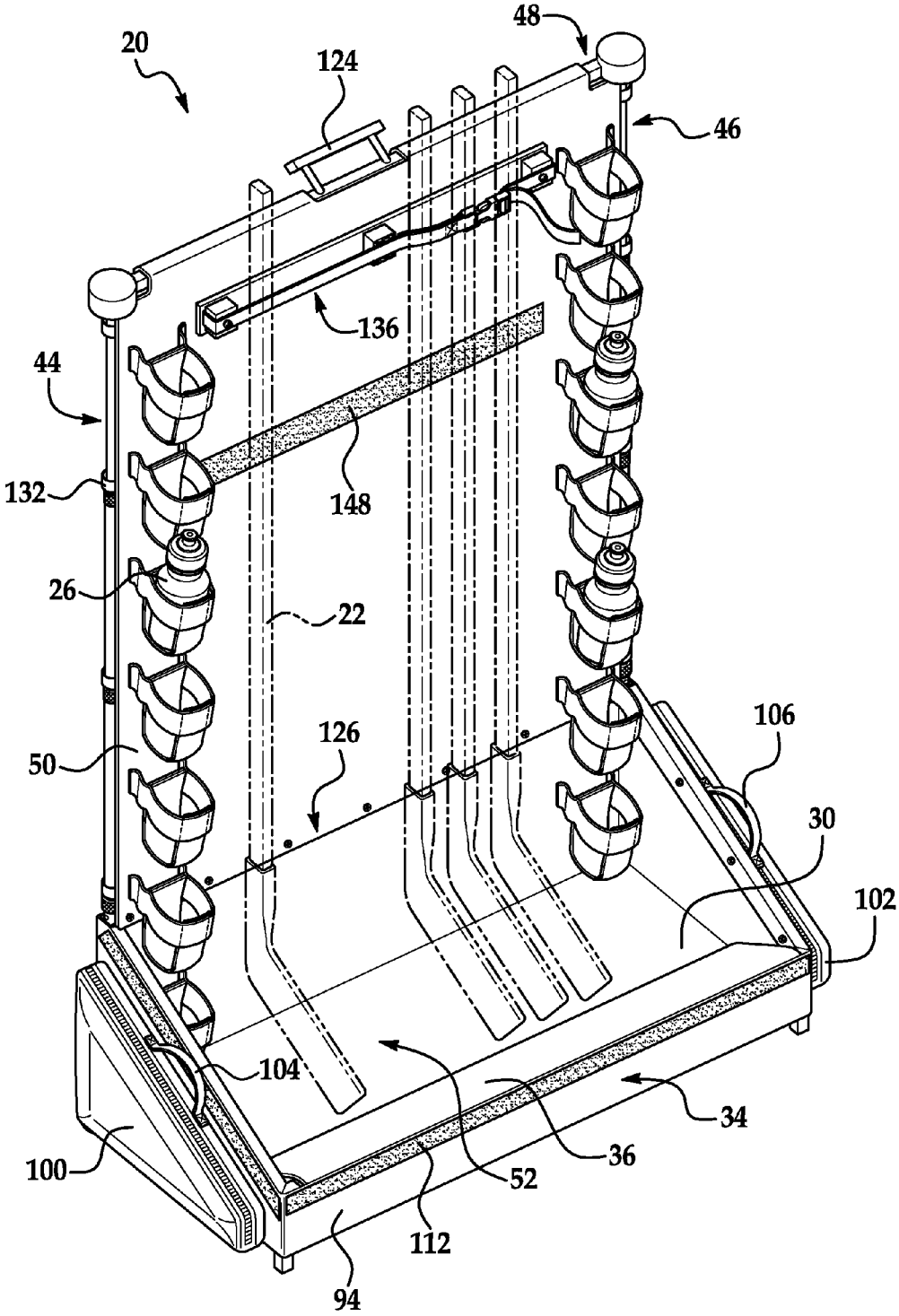
Figure 9:
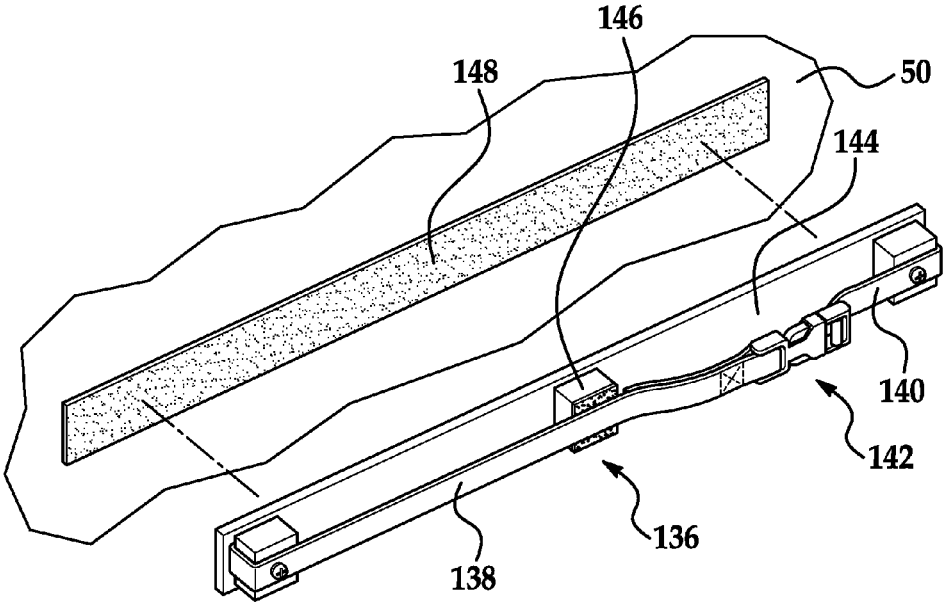
FIG. 9 is an enlarged perspective view of a portion of the flexible sheet of the device of FIGS. 2-3.
Figure 8A:
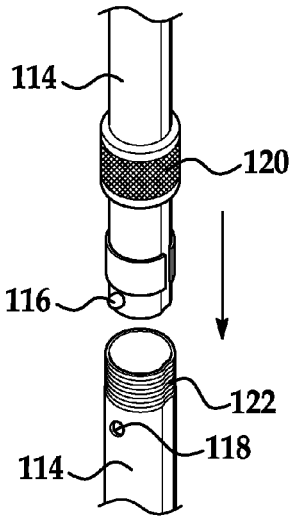
FIGS. 8A and 8B are enlarged perspective views of members of the extension arms of the device of FIGS. 2-3.
Figure 8B:
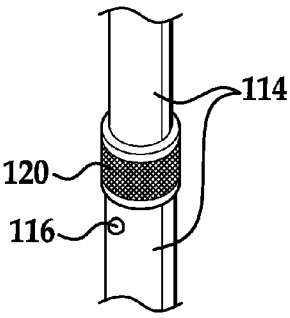

Referring to FIGS. 6-7, one end 126 of sheet 50 is configured to be fastened to frame 28. In one constructed embodiment, end 126 of sheet 50 is fastened to an interior side of upper rear cross member 76 using the same fasteners used to secure sheet 96 of covering 34. The other end 128 of sheet 50 is configured to be looped over handle 48 and supported by arms 44, 46. Sheet 50 may include an aperture 130 formed therein through which hand grip 124 of handle 48 may project. Sheet 50 may further includes means, such as a zipper, for coupling end 128 of sheet 50 to an intermediate portion of sheet 50 once end 128 is looped over handle 48. In one constructed embodiment, end 128 includes one set of teeth and a second set of teeth is disposed on an intermediate portion on the rearward side of sheet 50. The teeth may be brought together using a conventional zipper slider. Sheet 50 may further includes means for connecting sheet 50 to arms 44, 46. In particular, sheet 50 may include hook and loop fasteners (e.g., those sold under the trademark "VELCRO") formed on strips 132 of material sewn or otherwise fastened to sheet 50 on either side of sheet 50. These strips 132 of material may be looped around arms 44, 46 and joined to one another to secure sheet 50 to arms 44, 46 for further support of sheet 50 by arms 44, 46. Sheet 50 may further includes means for coupling cover 38 to sheet 50 when sheet 50 is in the extended state. In particular, a hook and loop fastener may again be used with cover 38 including one or more strips 110 of hooks or loops as discussed hereinabove and sheet 50 including one or more strips 134 of the other on the rearward side of sheet 50. In this manner, cover 38 may be secured to sheet 50 when sheet 50 is in the extended state so that cover 38 does interfere with movement of device 20 and takes up less space. In accordance with one embodiment of the invention, the strips 134 on sheet 50 includes the same structure (i.e. hooks or loops) as the strips of covering 34 on front wall 56 and are positioned on sheet 50 in such a way that the same strip 110 on the front end of cover 38 may be used to join cover 38 to covering 34 when sheet 50 is in the collapsed state or to sheet 50 when sheet 50 is in the expanded state with cover 38 fully extended.

Referring to FIG. 7, sheet 50 includes a restraining member 136 configured to receive a portion of an elongate item of athletic equipment such as a hockey stick 22 that extends between flooring 30 and member 136. Referring to 9, in one embodiment of the invention, the restraining member 136 includes a strap divided into two strips 138, 140, each having a first end configured to be fastened to sheet 50 and a second end to which one member of a conventional clasp 142 or other fastener is affixed. By joining the two members of clasp 142, elongate items of athletic equipment such as hockey sticks 22 may be held in an upright position against sheet 50. The end of each strip 138, 140 that is fastened to sheet 50 may be directly fastened to sheet 50 (e.g., by sewing the end of each strip 138, 140 to sheet 50). Alternatively, restraining member 136 may be indirectly fastened to sheet 50 to permit detachment of member 136 from sheet 50. Restraining member 136 may be coupled to a support plate 144. In the illustrated embodiment, plate 144 includes several spacers 146 that are used to space strips 138, 140 from plate 144 and provide additional support to the athletic equipment retained by restraining member 136. Referring again to FIG. 7, in accordance with one aspect of the present invention, sheet 50 includes a plurality of fasteners configured to allow plate 144 and, consequently, member 136 to be positioned at different locations on sheet 50 in order to accommodate athletic equipment of different lengths (so that device 20 can be used for different types of equipment or with different sizes dictated by, for example, the age of the participants in an activity). In particular, sheet 50 may include multiple strips 148 of hook and loop fasteners (e.g., those sold under the trademark "VELCRO") sewn or otherwise fastened to sheet 50 at different positions and configured to engage a corresponding strip of material attached to the back of plate 146.

Figure 10:
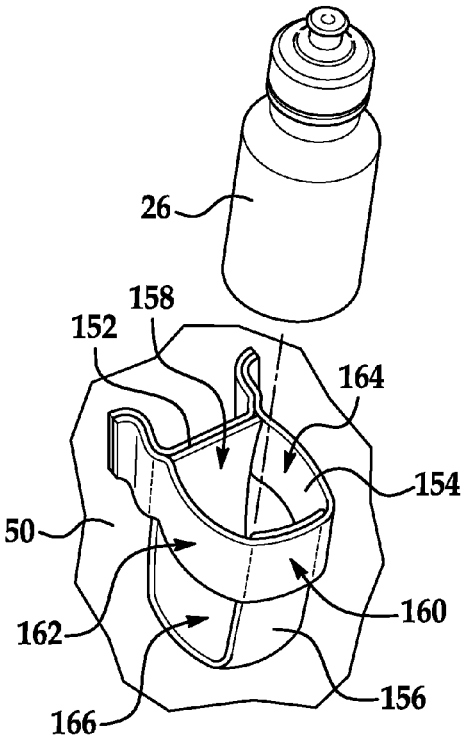
FIG. 10 in enlarged perspective view of another portion of the flexible sheet of the device of FIGS. 2-3 illustrating a bottle holder.

Sheet 50 may be further configured to support additional items of athletic equipment besides elongate items such as hockey sticks 22. In accordance with one aspect of the present invention, sheet 50 includes a plurality of bottle holders 150 configured to retain bottles such as water bottles 26. As a result, each player can store a bottle 26 in device 10 during play as opposed to having bottles scattered about the players' bench or other gathering area. Referring to FIG. 10, each bottle holder 150 may be formed using three strips 152, 154, 156 of a fabric such as canvas and/or woven polyester thread such as the material sold under the trademark "BAINTEX 600" by Bainbridge International, Inc. One strip 152 is fastened to sheet 50 at both ends (e.g., by sewing strip 152 to sheet 50) and forms a rear wall 158 for bottle 26. Another strip 154 is fastened to one or both of sheet 50 and strip 152 and forms a front wall 160 and side walls 162, 164 for bottle 26. Another strip 156 is fastened to the front and rear walls 158, 160 formed by strips 152, 154 and forms a well or bottom wall 166 for bottle 26. Bottle holders 150 may be arranged in multiple columns on either side of restraining member 136 (and the area where sticks 2 are stored) Additional bottle holders 150 may be fastened to sheet 96 of covering 34 in a similar manner and in line with those on sheet 50 to afford additional equipment storage.

A storage device 20 in accordance with the present invention is advantageous because it allows the efficient transportation and storage of athletic equipment and, particular, elongate items of athletic equipment such as hockey sticks, lacrosse sticks, and baseball and softball bats. As a result, players, coaches and other personnel will lose less time in transporting and organizing equipment and valuable equipment is less likely to be damaged or lost.

While the invention has been shown and described with reference to one or more particular embodiments thereof, it will be understood by those of skill in the art that various changes and modifications can be made without departing from the spirit and scope of the invention.

We claim:

1. A portable storage device for athletic equipment, comprising:

a frame defining a floor; and, a plurality of walls extending from said floor, each of said plurality of walls having an interior side and an exterior side, said interior sides of said plurality of walls defining a space therebetween;

a first arm supported by said frame, said first arm adjustable between a collapsed state and an extended state; and, a flexible sheet adjustable between a first state in which said flexible sheet is collapsed and configured to be disposed within said space and a second state in which said flexible sheet is extended and configured to be supported by said first arm when said first arm is in said extended state, said flexible sheet including a restraining member configured to receive a portion of an elongate item of athletic equipment extending between said floor and said restraining member.

2. The portable storage device of claim 1, further comprising a second arm supported by said frame, said second arm adjustable between a collapsed state and an extended state, said flexible sheet configured to be supported by said second arm when said second arm is in said extended state.

3. The portable storage device of claim 2, further comprising a handle connecting said first and second arms and oriented substantially perpendicular to said first and second arms.

4. The portable storage device of claim 3 wherein a portion of said handle extends through said flexible sheet when said flexible sheet is in said second state.

5. The portable storage device of claim 1, further comprising at least one wheel coupled to said frame.

6. The portable storage device of claim 1, further comprising a cover coupled to said frame and configured to enclose said space when said flexible sheet is in said first state.

7. The portable storage device of claim 6 wherein at least one of said cover and said flexible sheet include fasteners configured to couple said cover to said flexible sheet when said flexible sheet is in said second state.

8. The portable storage device of claim 1 wherein at least one wall of said plurality of walls includes a storage compartment formed in said exterior side of said at least one wall.

9. The portable storage device of claim 1 further comprising a divider that divides said space into a plurality of subspaces.

10. The portable storage device of claim 9, further comprising a cover connected to said frame and configured to enclose a first subspace of said plurality of subspaces.

11. The portable storage device of claim 1 wherein said first arm comprises a plurality of telescoping members.

12. The portable storage device of claim 11, further comprising means for locking one of said plurality of telescoping members in a position relative to another of said plurality of telescoping members.

13. The portable storage device of claim 12 wherein said locking means comprises a knob extending from said one telescoping member and biased through an aperture in said another telescoping member.

14. The portable storage device of claim 12 wherein said locking means comprises a sleeve disposed about said one telescoping member and having a first plurality of threads configured to engage a second plurality of threads formed on an outer surface of said another telescoping member.

15. The portable storage device of claim 1 wherein said frame includes a tubular member and a portion of said first arm is disposed within said tubular member.

16. The portable storage device of claim 1, further comprising a bottle holder coupled to said flexible sheet.

17. The portable storage device of claim 1 wherein said restraining member is fastened to said flexible sheet.

18. The portable storage device of claim 17 wherein said flexible sheet includes a plurality of fasteners configure to allow said restraining member to be positioned at different locations on said flexible sheet.

19. A portable storage device for athletic equipment, comprising:

a frame defining a floor; and, a plurality of walls extending from said floor, each of said plurality of walls having an interior side and an exterior side, said interior sides of said plurality of walls defining a space therebetween;

means for supporting an elongate item of athletic equipment, said supporting means adjustable between a first state in which said supporting means is collapsed and configured to be disposed within said space and a second state in which said supporting means is extended and receives a portion of an elongate item of athletic equipment extending between said floor and said supporting means; and, means, supported by said frame, for bearing said supporting means in said second state.

20. The portable storage device of claim 19 wherein said bearing means comprises first and second arms supported by said frame and adjustable between a collapsed state and an extended state, each of said first and second arms comprising a plurality of telescoping members.

* * * * *